US005807024A

United States Patent [19]

Benedict

[11] Patent Number: 5,807,024

[45] Date of Patent: Sep. 15, 1998

[54] BIODEGRADABLE GROYNES

[75] Inventor: Charles E. Benedict, Tallahassee, Fla.

[73] Assignee: Beach Reclamation, Inc., Tallahassee, Fla.

[21] Appl. No.: 665,301

[22] Filed: Jun. 17, 1996

[51] Int. Cl.[6] ..... E02B 3/06; E01F 7/02

[52] U.S. Cl. ..... 405/32; 405/21; 405/15; 256/12.5

[58] Field of Search ..... 405/21, 32, 33, 405/34; 256/12.5, 23

[56] References Cited

U.S. PATENT DOCUMENTS

| | | | |
|---|---|---|---|
| 449,185 | 3/1891 | Solomon . | |
| 812,045 | 2/1906 | Kellner | 405/32 |
| 1,609,633 | 12/1926 | Rehfeld | 405/32 |
| 1,627,623 | 5/1927 | Smith | 405/32 |
| 1,841,594 | 1/1932 | Dysart | 405/32 |
| 1,844,484 | 2/1932 | Smith . | |
| 2,135,337 | 11/1938 | Herbest, Jr. . | |
| 2,389,395 | 11/1945 | Tholstrup | 256/12.5 |
| 3,564,853 | 2/1971 | Csiszar . | |
| 4,710,056 | 12/1987 | Parker . | |
| 4,738,563 | 4/1988 | Clark . | |
| 4,861,193 | 8/1989 | Newkirk . | |
| 5,108,222 | 4/1992 | Jansson et al. . | |
| 5,255,997 | 10/1993 | Bailey et al. . | |
| 5,348,419 | 9/1994 | Bailey et al. . | |
| 5,720,573 | 2/1998 | Benedict et al. . | |

*Primary Examiner*—Tamara L. Graysay
*Assistant Examiner*—Gary S. Hartmann
*Attorney, Agent, or Firm*—Dowell & Dowell, P.C.

[57] ABSTRACT

A method and apparatus for shoreline reclamation which includes the deployment of groyne structures including supporting stanchions to which are mounted at least one porous and pliable screen material wherein the screen is formed of biodegradable materials.

12 Claims, 2 Drawing Sheets

W
10
11
12
14
15
16
17
18
19
20
22

BIODEGRADABLE GROYNES

BACKGROUND OF THE INVENTION

1. Field of the Invention

The present invention is directed to porous groyne structures and method for their use in reclaiming beach and shoreline areas which are subject to erosion by natural forces and, more specifically, to porous groyne structures which are constructed of pliable, biodegradable materials and designed to remain in place during and after the buildup of silt, sand, shells, grasses and other materials so that no disruptive displacement of the built up materials is necessary as the reclamation process progresses.

2. History of the Related Art

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion, large seawalls are constructed in some areas to prevent high tides from reaching land and property. Such structures are costly and are only practical when population densities make it economically reasonable to construct them. Further, such structures have an adverse effect on the natural appearance as well as the natural ecology of the shoreline and, in many areas, cannot be practically used.

Other methods of shoreline reclamation include creating jetties or artificial barriers or reefs which extend from the shoreline. These structures are permanent installations and are generally utilized to prevent sand along coastal areas from washing out to sea by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated.

A further method for reclaiming shoreline areas and preventing further erosion is the placement of off-shore, underwater barriers. Often, large porous structures are placed along a seafloor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand importation. When major dunes along a shoreline are damaged or washed away during heavy storms, it is often necessary to import new dirt and sand to re-establish the dunes to provide a natural barrier to tidal activity. Dredgers are commonly utilized to pump sand from a seafloor or riverbed to build up natural barriers. Such methods of shoreline reclamation, however, are temporary measures, at best, and do not provide a long-term solution to shoreline erosion. Further, such restoration methods are extremely costly and are not practical in many locations.

In view of the foregoing, there is a need to provide a method and apparatus for economically reclaiming damaged shorelines and beach areas which can be practically used in almost any area without an adverse effect to either land or sea environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly deposited material, are withdrawn by winches or other means. The removal of the netting material can adversely affect the restored shoreline by creating trenches or furrows which form natural channels in which water flows away from the shoreline thereby conveying particulate matter back to a body of water.

Other examples of porous shoreline reclamation structures are disclosed in U.S. Pat. Nos. 227,483 to Case, 1,060,357 to Nies, 1,948,639 to Youngberg, 1,646,168 to Pringle, 2,097,342 and 2,341,515 to Reheld, 2,135,337 to Herbert, Jr., 2,662,378 to Schmitt, et al., 3,564,853 to Csiszar, 4,861,193 to Newkirk, 4,118,937 to Mansen, 4,738,563 to Clark, 5,108,222 to Jansson, et al., and 5,255,997 to Bailey, et al.

SUMMARY OF THE INVENTION

The present invention is directed to a method and apparatus for reclaiming shoreline and offshore areas which includes an installation of groynes having at least two support posts or stanchions which are embedded along the shoreline and/or in the seafloor or riverbed in spaced relationship with one another and between which are mounted one or more porous nets or screens constructed of biodegradable materials. As used herein, the term shoreline refers to both land and offshore bottom areas including beaches and banks situated along lakes, rivers, inlets, bays, seas, oceans and the like, it being the express purpose of the present invention to build up solid material deposits both on and offshore.

The nets or screens may be formed of any suitable biodegradable material having a plurality of openings therein. It is preferred that the material will biodegrade over a relatively short period of time when submerged in a water environment and particularly in a salt water environment. Appropriate materials may include polymethyl acrylate, untreated cotton, hemp, Starch-G polymethyl acrylate, and Starch-G poly vinyl alcohol.

The nets or screens are preferably formed so that when originally deployed, the lower portion of the screen is embedded in or gathered along the shoreline in contact with the existing soil or sand. In the preferred embodiment, the nets or screens are deployed to a height which is generally equal to the anticipated height of the buildup of reclamation material desired along a given shoreline so that, once deployed, the nets or screens are left in place to biodegrade and become part of the reclaimed shoreline.

It is a primary object of the present invention to provide a method and apparatus for reclaiming shoreline and offshore areas utilizing groyne structures which are environmentally compatible and which are constructed of biodegradable materials so that once deployed, the groynes decompose to become part of the reclaimed deposited materials.

It is also an object of the present invention to provide a method and apparatus for economically reclaiming land along shorelines and offshore areas of oceans, gulfs, inlets, bays, rivers, lakes as well as other areas where currents and tidal and/or wind activity is experienced.

It is a further object of the present invention to provide a biodegradable porous groyne structure for reclaiming land along shoreline and offshore areas wherein the groynes may be deployed and naturally deteriorate without disturbing the contour of the newly reclaimed deposited materials.

BRIEF DESCRIPTION OF THE DRAWINGS

The invention will be best understood with reference to the accompanying drawings wherein.

DESCRIPTION OF THE PREFERRED EMBODIMENT

Figures 1, 2, 3:
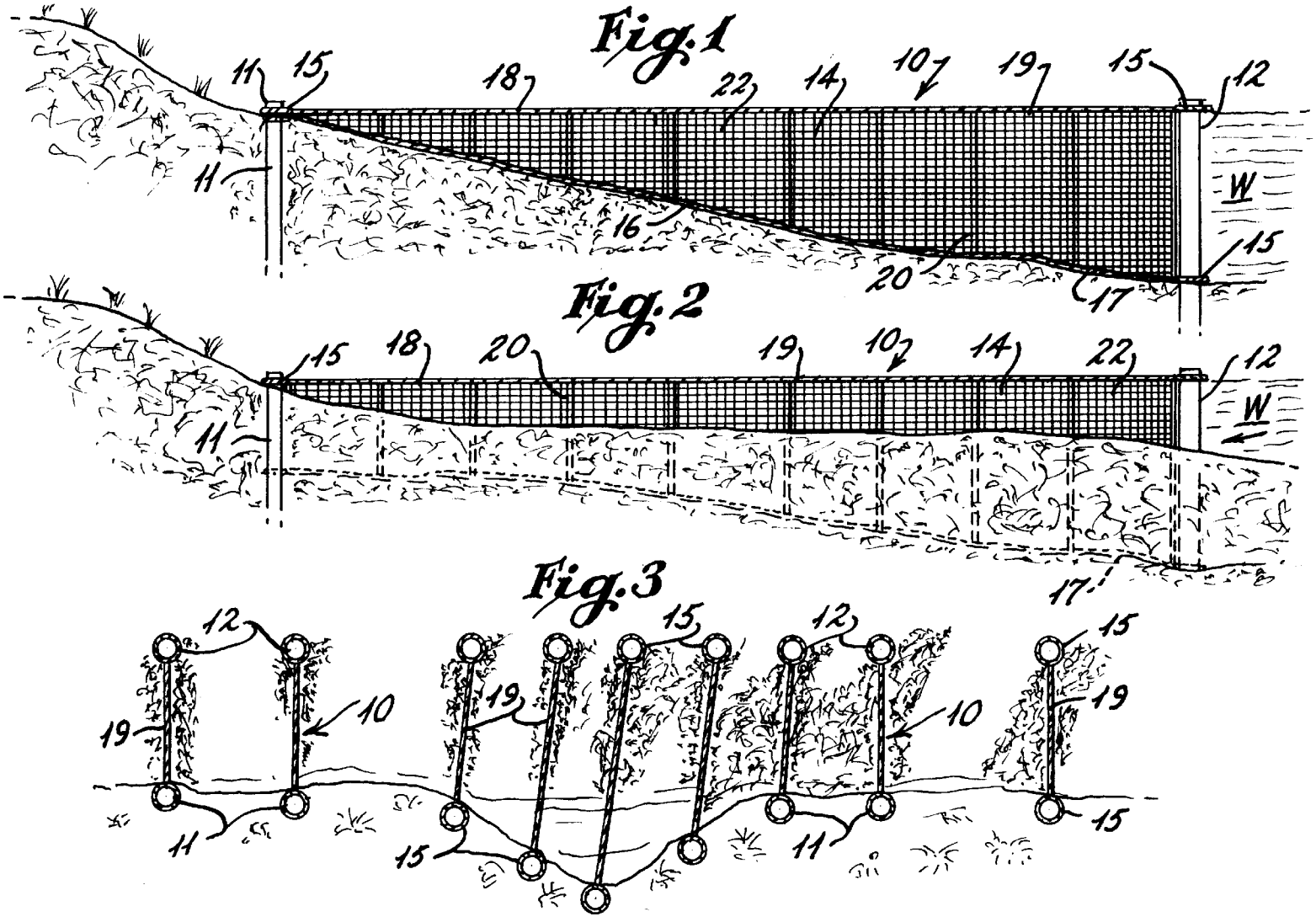
FIG. 1 is a side illustrational view of a porous groyne structure of the present invention as initially deployed to reclaim land along a shoreline.
FIG. 2 is a side illustrational view showing the buildup of materials along the lower portion of a porous groyne of the present invention.
FIG. 3 is a top plan illustrational view showing a plurality of porous groynes deployed along a shoreline in accordance with the teachings of the present invention.

With continued reference to the drawing figures, the present invention will be described in use for the reclamation of shorelines along bodies of water which are subject to natural erosion by waves, currents, tidal activity and wind. The porous groynes may be utilized in substantially any environment where it is desired to reclaim material for the buildup of landmasses adjacent any body of water.

With specific reference to FIG. 1, the porous groyne structure 10 is shown placed so as to extend outwardly into a body of water "W". The structure may extend offshore into the body of water a preselected distance and normally will extend outwardly beyond a low tide line. The structure includes at least two spaced posts or stanchions 11 and 12. The stanchion 11 is embedded into the earth along the shoreline whereas the stanchion 12 is embedded into the floor of the body of water. The stanchions may be formed of any appropriate environmentally compatible material which is sufficiently rigid to support a predetermined length of a porous screen or netting 14 which is secured at its opposite ends to the stanchions by way of biodegradable ties 15. Each stanchion is embedded a sufficient distance to support the net or screen during use.

As shown in FIG. 1, the lower edge portion 16 of the screen should remain in close proximity to or in contact with the existing shoreline material. In this respect, a rope, tape or other strand of material 17 may be extended between the stanchions along the existing shoreline material. Such a rope is formed of a completely biodegradable material so that once deployed, the rope will decompose to become part of the reclaimed shoreline material. As opposed to providing a rope, tape or other strand of biodegradable material at the lower edge of the screen, or in conjunction therewith, the lower edge of the screen may be embedded in the existing shoreline material. In this manner, the lower edge of the screen is retained in a deployed position.

The upper edge 18 of the screen is supported by a rope, tape or other strand 19 which is also formed of a biodegradable material. In some embodiments, and as shown in FIG. 1, the screen or netting may be reinforced by either vertical or horizontal biodegradable tapes or ropes 20 which extend from the upper tape or rope 19 to the lower edge 16 of the screen and/or along the length thereof and tied to the stanchions 11 and 12, respectively.

The screens are designed to permit fluid and small particles to pass therethrough and to block the passage of various larger solids. The screens are formed of biodegradable netting materials or fiber strands such as polymethyl acrylate, untreated cotton, hemp, Starch-G polymethyl acrylate, and Starch-G poly vinyl alcohol. Openings 22 formed in the material may be uniform or not throughout the screen and may vary in dimension from the lower portion of the screen adjacent the lower edge portion 16 towards the upper edge portion 18. The screens obstruct larger particles carried by the water and reduce the flow velocity of the water so that the particles settle out of the water and collect and buildup along the lower portion of each screen, as shown by illustration in FIGS. 4 through 6.

In the preferred embodiment, the upper edge portion 18 of the screen is installed at an elevation close to the desired final elevation of the shoreline to be reclaimed. As material is deposited along the shoreline by settling out of the water, the material will continue to build against each screen as illustrated. As the screen material is biodegradable, the screen will become part of the newly deposited materials with the entire screen structure and any supporting ropes and tapes deteriorating and becoming an environmentally compatible shoreline material. After the shoreline has been reclaimed to a desired elevation, the stanchions 11 and 12 may be removed or they, too, may be formed of a biogradable material.

The biodegradable screens of the present invention provide a unique advantage over prior art reclamation structures in that the screens may be installed and left to become part of the newly formed shoreline without any adverse environmental impact. Further, because the porous groynes of the present invention are designed to be installed and deteriorate naturally, and it is not necessary to adjust or remove the screens after use. This not only saves the cost of manpower, but ensures that the reclaimed material is not disturbed to remove the screens.

With reference to FIG. 3, one example of orientation for the deployment of the porous groynes of the present invention are shown. The action of waves along a beach is indicated by the arrows in the drawing figure. The orientation of the porous groynes will be determined based upon the particular contour of an area being reclaimed. In FIG. 3, the porous groynes are shown as being generally parallel with one another and with the spacing between the groynes being varied.

Figure 4:
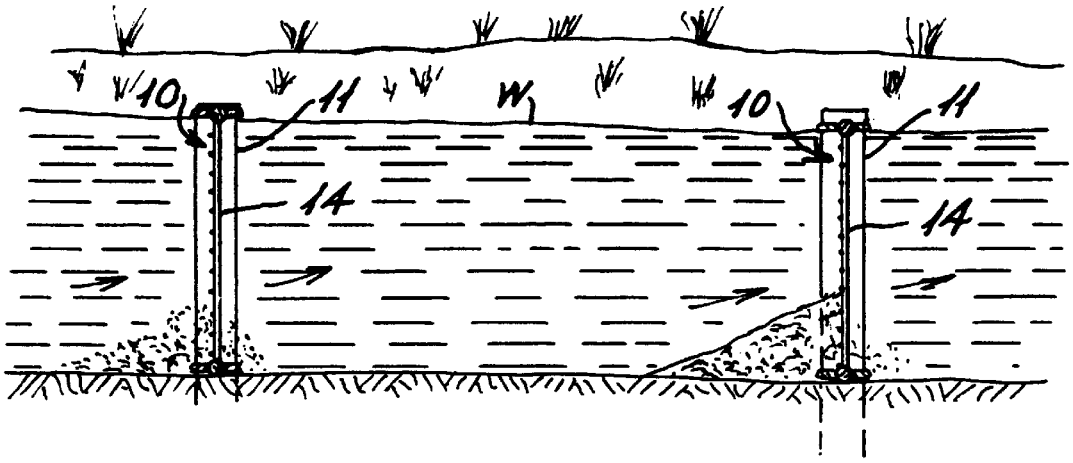
FIG. 4 is a cross-sectional view of a pair of porous groyne structures in accordance with the teachings of the present invention shown as originally being deployed with material beginning to buildup along the lower edge of the groynes.
Figure 5:
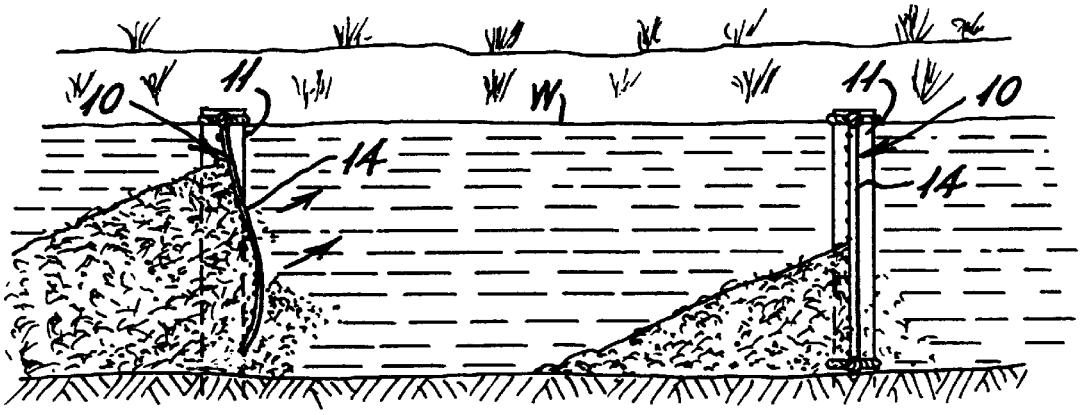
FIG. 5 is a view similar to FIG. 4 illustrating an intermediate buildup of material and the initial deterioration of a portion of the netting structure of the porous groynes of the present invention.
Figure 6:
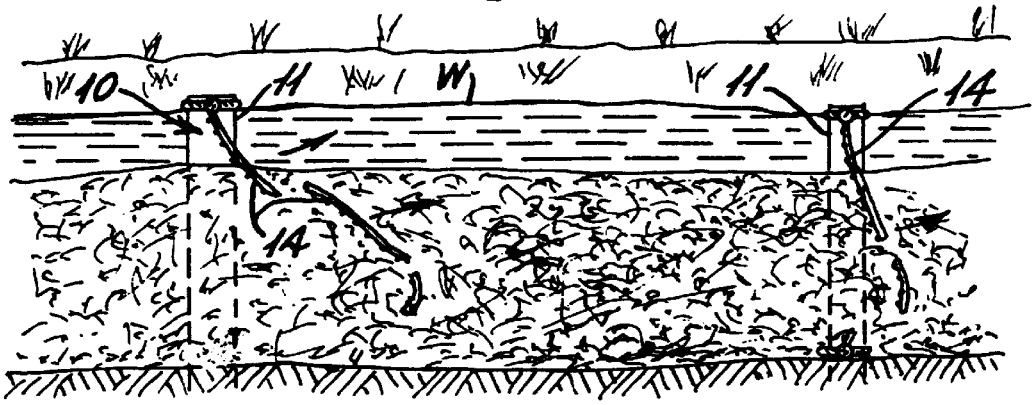
FIG. 6 is a view similar to FIG. 5 illustrating the reclaimed material being substantially built up along the shoreline with the porous netting being decomposed and incorporated within the deposited material.

FIGS. 4 through 6 illustrate the manner in which the groynes function to trap and build up material deposits. After a period of time with the groynes in use, material is deposited to an intermediate height, see FIG. 5. As shown, the lower portion of the netting has already begun to deteriorate and become part of, the reclaimed material. In FIG. 6, the deposited material has increased toward the upper edge of the screen and the screen has substantially deteriorated, becoming part of the reclaimed shoreline.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A method of reclaiming land along a shoreline and offshore area by causing the deposit and retention of particulate material utilizing a plurality of spaced groynes wherein each groyne includes at least two spaced supporting stanchions which support at least one net member defined by generally transversely oriented fiber strands which are spaced to create a plurality of openings formed therethrough through which water will flow to cause particulate material to deposit adjacent the net member and which openings are of a size to prohibit passage of larger solid materials carried by water currents and wherein the net member has upper and lower portions and opposite ends, the method comprising the steps of:

a) placing the stanchions in spaced relationship relative to one another extending offshore relative to the shoreline;

b) mounting the at least one biodegradable net member to the spaced stanchions so that the net member extends in a direction defined between the spaced stanchions and so that the lower portion thereof is proximite to an offshore floor to thereby create a buildup of newly deposited solid materials adjacent the lower portion thereof;

c) allowing the at least one net member to deteriorate and become part of the buildup of newly deposited solid materials.

2. The method of claim 1 including the step of initially embedding at least a portion of the lower portion of the biodegradable net member within the material of the shoreline or offshore area.

3. The method of claim 2 including the additional step of initially mounting the at least one biodegradable net member so that the upper portion thereof is at an elevation approximately equal to an elevation to which the shoreline is to be reclaimed.

4. The method of claim 1 wherein the step of mounting includes securing the opposite ends of said at least one biodegradable net member to the at least two spaced supporting stanchions utilizing biodegradable securing materials.

5. The method of claim 1 in which said step of mounting includes supporting the upper portion of the at least one biodegradable net member from a a biodegradable support secured to and extending between said at least two spaced supporting stanchions.

6. A groyne structure for reclaiming shoreline and off shoreline areas comprising, at least two spaced stanchions, a biodegradable open mesh net member having upper and lower portions and extending between said at least two stanchions, said net member defined by generally transversely oriented fiber strands which are spaced to create openings therebetween, and means for securing said screen means to said at least two stanchions.

7. The groyne structure of claim 6 wherein said means for securing are biodegradable ties.

8. The groyne structure of claim 7 wherein said stanchions are biodegradable.

9. The groyne structure of claim 6 in which said net member includes biodegradable reinforcing members.

10. The groyne structure of claim 6 wherein said net member is formed of fiber strands of a material selected from a group of biodegradable materials consisting of polymethyl acrylate, untreated cotton, hemp, starch-G polymethyl acrylate and starch-G polyvinyl alcohol.

11. The groyne structure of claim 6 in which said means for securing includes a first biodegradable strand member extending between and secured to said at least two stanchions for supporting said upper portions of said net member.

12. The groyne structure of claim 11 including a second biodegradable strand member extending between said at least two stanchions and engaging said lower edge portion of said net member.

* * * * *